US005183437A

United States Patent [19]

Millay et al.

[11] Patent Number: 5,183,437

[45] Date of Patent: Feb. 2, 1993

[54] METHOD AND APPARATUS FOR INITIATING A WATER RIDE

[75] Inventors: George D. Millay, San Diego; John D. Powell, Del Mar, both of Calif.

[73] Assignee: Wet 'N Wild, Inc., Grand Prairie, Tex.

[21] Appl. No.: 708,895

[22] Filed: May 31, 1991

[51] Int. Cl.[5] ..... A63G 21/18

[52] U.S. Cl. ..... 472/117; 472/116; 472/128

[58] Field of Search ..... 472/88, 89, 116, 117, 472/128

[56] References Cited

U.S. PATENT DOCUMENTS 2,991,726 7/1961 Miller ..... 472/117 X
3,210,077 10/1965 Hjelte ..... 472/116
4,484,739 11/1984 Kreinbihl et al. ..... 472/88

*Primary Examiner*—Richard E. Chilcot, Jr.
*Attorney, Agent, or Firm*—David H. Judson

[57] ABSTRACT

A method and apparatus for initiating a thrill-seeking ride from a raised access platform, the ride having a water slide descending at a predetermined angle with respect to the platform and wherein the slide has a support or "riding" surface located along a predetermined plane. According to the method, the rider is placed in a substantially erect position within a housing while the housing is located at a first position on the raised access platform. The housing has at least a back and a releasable bottom. Thereafter, the housing with the rider therein is extended from the first position on the raised access platform to a second position wherein the back of the housing is substantially aligned with the predetermined plane of the slide support surface. The bottom of the housing is then released to drop the rider onto the water slide.

19 Claims, 6 Drawing Sheets

METHOD AND APPARATUS FOR INITIATING A WATER RIDE

TECHNICAL FIELD

The present invention relates generally to amusement park rides and more particularly to a method and apparatus for initiating a thrill-seeking ride from a raised access platform having a water slide descending therefrom.

BACKGROUND OF THE INVENTION

Over the past several years, "water parks" have become extremely popular. Such parks include a myriad of water rides for children and adults of all ages. One such ride includes a raised access platform having a slide descending therefrom at a predetermined, generally steep angle. Water is directed onto the slide to decrease friction and thus increase the rider's rate of descent. The slide terminates in a splash pool of water. To initiate a ride, the rider steps into a start pool located on the access platform. The start pool is attached to the upper end of the water slide. To enter the ride, the rider wads to the end of the pool and manually enters the ride by stepping out onto the slide.

While this type of water ride has proven extremely successful, it is desirable to provide an improved method of initiating such a ride to enhance the rider's enjoyment.

BRIEF SUMMARY OF THE INVENTION

It is an object of the present invention to provide a novel method for initiating a water ride wherein a rider is placed in a simulated "bomb" housing and dropped onto the water slide in a fully erect position.

It is yet another object of the present invention to provide an apparatus for initiating such a water ride that includes a housing for supporting the rider in an erect position, and means for discharging the rider from the bottom of the housing directly onto the water slide while in such a position.

It is a further object of the invention to provide a method and apparatus for safely initiating a water ride while providing increased enjoyment of the ride.

These and other objects of the invention are provided in a method and apparatus for initiating a thrill-seeking ride from a raised access platform, the ride preferably including a water slide descending at a predetermined angle with respect to the platform and having a support surface located along a predetermined plane. According to one embodiment of the invention, the rider is placed in a substantially erect position within a housing while the housing is located at a first position on the raised access platform. The housing has at least a back and a releasable bottom. Thereafter, the housing with the rider therein is extended from the first position on the raised access platform to a second position wherein the back of the housing is substantially aligned with the predetermined plane of the slide support surface. Preferably, the back is parallel to and slightly ahead (by approximately ¼") of the slide support surface. The bottom of the housing is then released to drop the rider onto the water slide.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
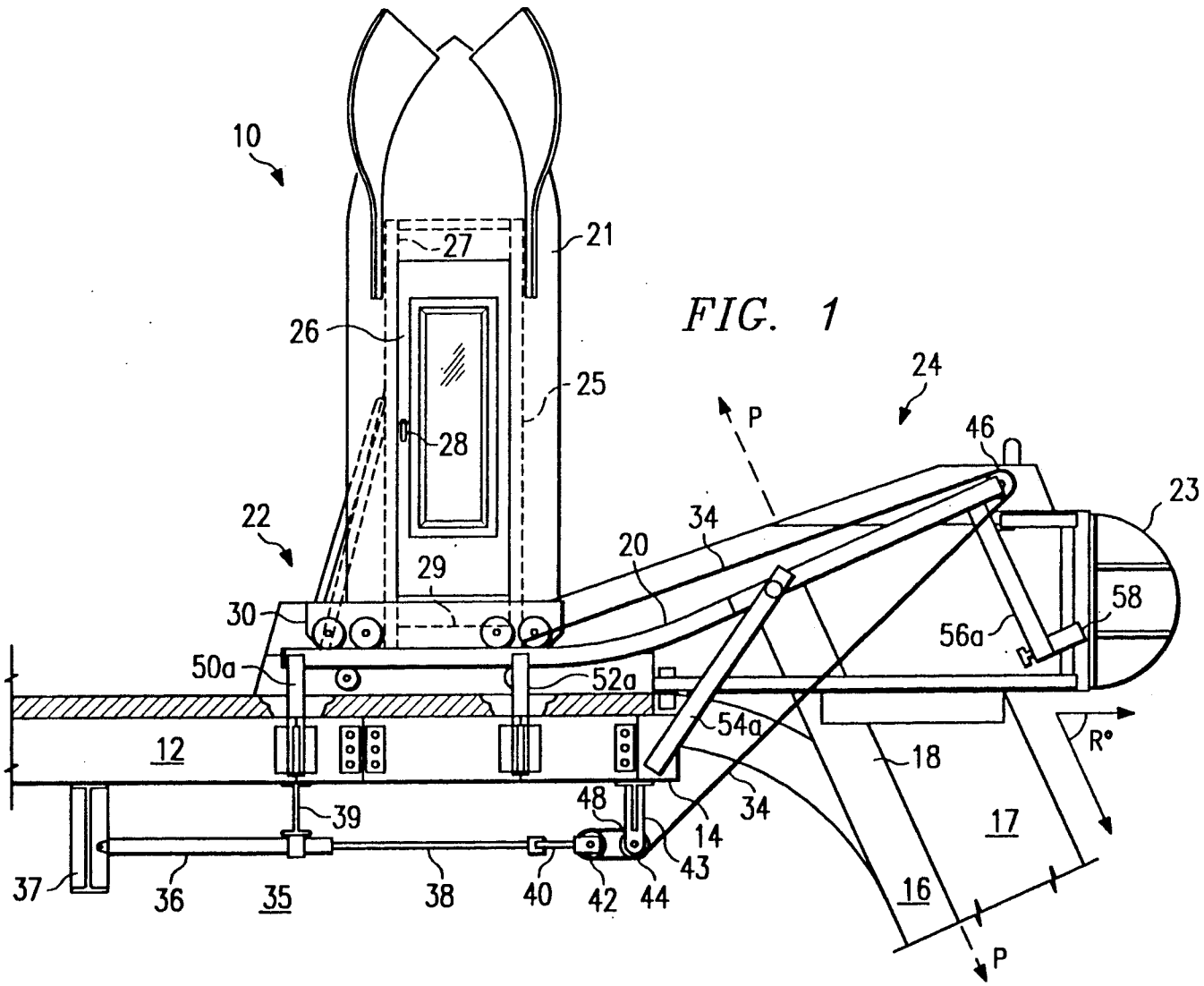
FIG. 1 is a elevation view of the apparatus of the present invention with the housing supported in a first or "loading" position.

Referring now to FIG. 1, the apparatus for initiating a ride on a water slide is shown in the "loading" position. The apparatus is designated by the reference numeral 10 and is in part supported on a platform 12 located above the ground. Access to the platform is achieved through a stair tower, steps or elevator means (not shown). The access platform 12 is generally horizontal and has an end 14. The water ride includes a water slide 16 that descends at a predetermined angle R with respect to the platform. The slide 16 includes side portions 17 for safety. The descent angle R is substantially uniform for the upper end 18 of the slide 16 (i.e., the end nearest the platform) but gradually decreases as the slide approaches the ground. Viewed in profile, the slide has a downwardly-sloping curved shape. For the purposes herein, the descent angle R refers to the angular relationship between the platform and that portion of the slide nearest the platform. As seen in FIG. 1, an upper end 18 of the water slide 16 is supported above and adjacent the end 14 of the platform by suitable support means (not shown).

The apparatus includes a track 20 supported on the platform 12 which extends from a first or "loading" position along the platform to a second or "launch" position. The first position is designated by the reference numeral 22 and the second position is designated by numeral 24. As seen by comparing FIGS. 1 and 2 together, the second position is located above the upper end 18 of the water slide 16.

Figure 2:
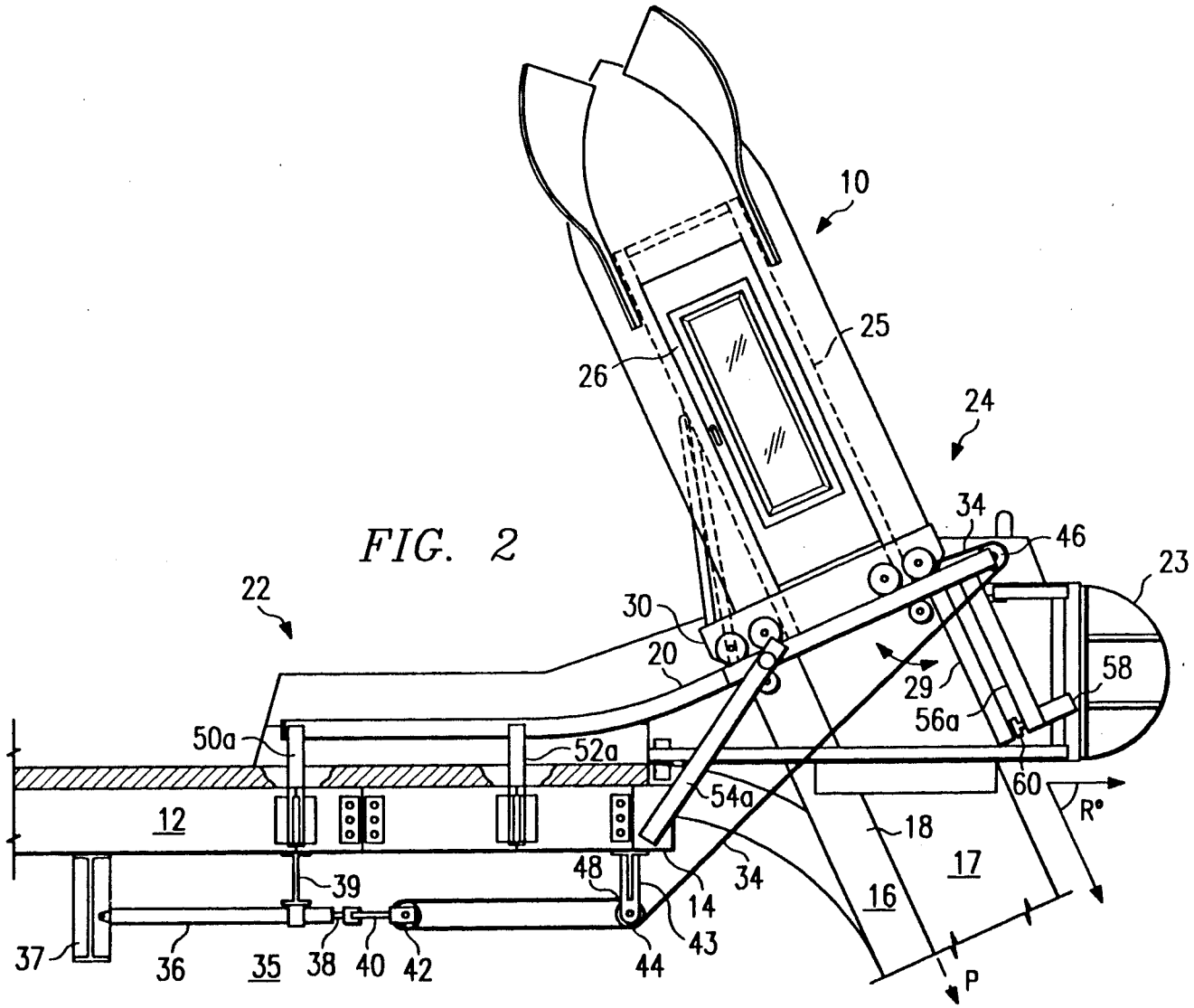
FIG. 2 is a elevation view of the apparatus of FIG. 1 with the housing supported in a second or "launch" position in accordance with the present invention.

The apparatus also includes a housing 25 for supporting therein a rider in a substantially erect, i.e., standing, position. The housing includes a door 26 that is opened via handle 28 to obtain access to the interior of the housing. The frame surrounding the door 26 includes a limit switch which must be depressed (due to closure of the door in a secure fashion) before the ride is initiated as will be described below. The housing 25 includes at least a back 27 and a bottom 29 for supporting the rider in the erect position as the housing is reciprocated on the track 20. Such reciprocation is effected by a carriage 30 on which the housing 25 is supported. The carriage 30 is maintained in the track 20 and is adapted for rolling movement on the track 20 between the first and second positions 22 and 24, respectively, as shown in FIGS. 1 and 2.

In operation, a rider is placed in a substantially erect position within the housing 25 while the housing is located at the first position 22 on the raised access platform 12. As used herein, a rider is "placed in" the housing for example by opening the door 26 and stepping into the housing. Once the door is closed and the rider is secure, the housing 25 with the rider therein is extended from the first position 22 on the raised access platform to the second position 24 wherein the back 27 of the housing is substantially aligned with a plane P of the slide support surface. In particular, the back 27 is located parallel to and slightly ahead (by about ¼") of the slide support surface. At this point, a short delay is preferably imposed to heighten the rider s anticipation or to give the rider an opportunity to abort the ride. Thereafter, the bottom 29 of the housing is released to automatically drop the rider onto the slide by the force of gravity. Because of the orientation of the housing and the upper end of the slide, the rider is "discharged" or launched onto the slide in a standing position, thus substantially approximately the feel of a controlled "free-fall." After the rider is discharged, the bottom of the housing is retracted, and the housing is then returned from the second position 24 to the first position 22 to receive another rider. The above steps are then repeated for the next rider.

An intercom can be placed in the housing and controlled by the ride operator to enable the operator to communicate with the rider. In particular, after the operator causes the housing to be extended, the operator may interrogate the rider (during the brief delay) to insure that the rider desires to proceed.

The carriage 30 is reciprocated on the track 20 between the loading and discharge positions using a drive mechanism, designated generally by the reference numeral 35, that is operably coupled to the carriage 30 by a pair of cables and a system of pulleys. The drive mechanism 35 includes a pneumatic cylinder 36 in which a piston 38 is supported for reciprocating movement. Cylinder 36 is supported by beams 37 and 39. The end of the piston 38 supports a Y-shaped yoke 40. Each end of the yoke supports a pulley 42, one of which is shown in FIG. 1. The system of pulleys includes another set of pulleys, one of which is shown as reference numeral 44. The pulley 44 is supported on a shaft (not shown) journaled to a pair of support posts, one of which is designated by numeral 43. Yet another pair of pulleys are supported adjacent the distal end of the track 20. One of these pulleys is designated by the reference numeral 46. The cable 34 is attached at one end to the carriage and extends around pulley 46 and underneath the track 20. The cable is passed around a portion of the pulley 44 and then around pulley 42. The end 48 of the cable is then attached to a fixed point or other suitable retaining means on the pulley 44. The other cable, not shown, is supported in a similar manner on the opposite side of the track.

Accordingly, when the pneumatic cylinder is activated, the piston 38 is retracted, thus pulling the yoke 40 and the cables toward the cylinder. This movement extends the carriage between the first and second positions as previously described. Although not described in detail, it should be appreciated that other suitable drive mechanisms, such as a pneumatic cylinder and ram (supported above the platform rather than below), can be used to reciprocate the carriage directly instead of using a cable and pulley system.

Figure 3:
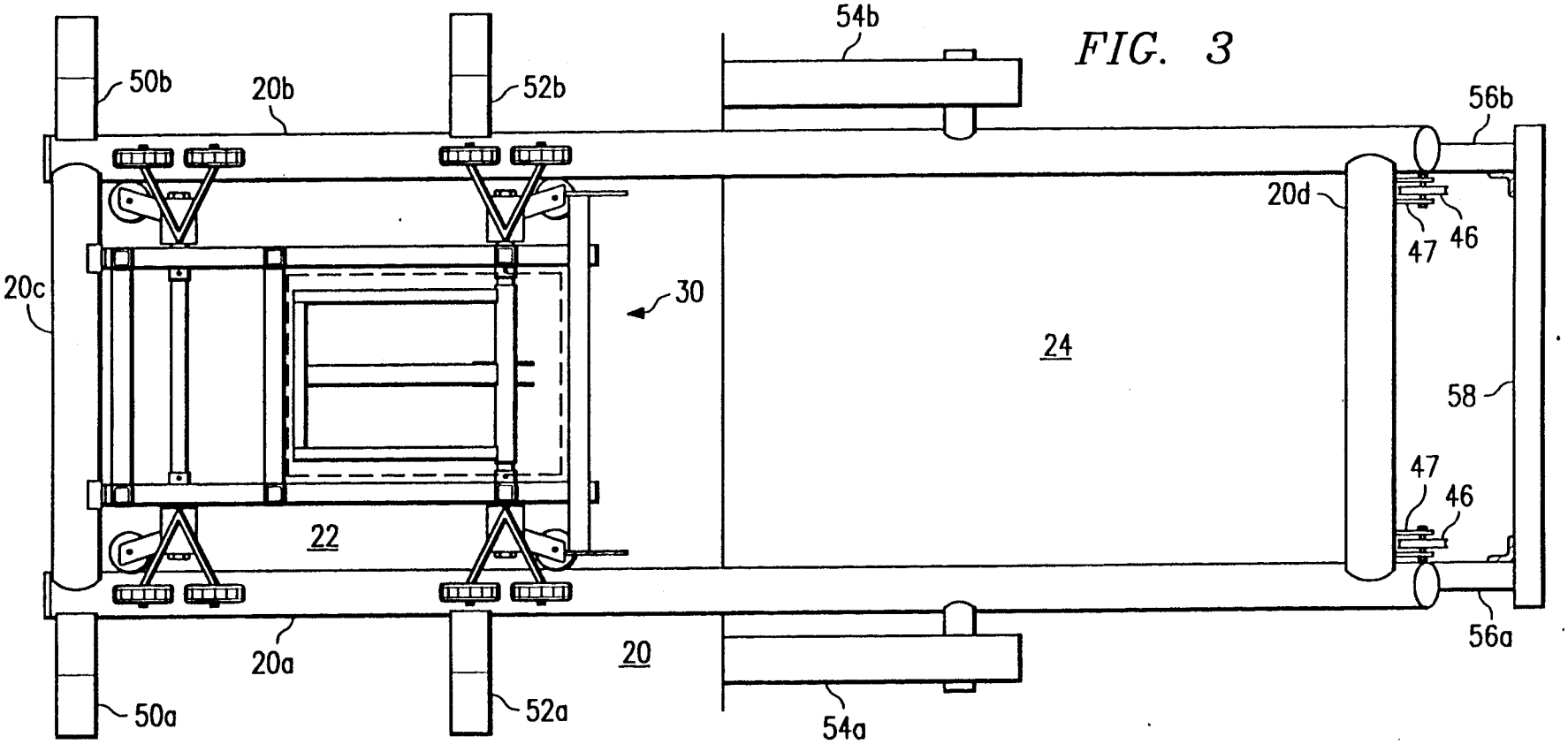
FIG. 3 is a plan view of the track and carriage assemblies used to extend the housing between the loading and discharge positions.

Referring now to FIG. 3, a plan view is shown of the preferred structure of the track 20. The track 20 is supported on (and preferably slightly above) the platform and extends between the first and second positions. The track 20 comprises first and second parallel-spaced rails **20*a* and 20*b* each having an upwardly-curving profile (as seen in FIGS. 1–2). A first end rail 20*c* lies transversely to the first and second parallel-spaced rails and is located adjacent the first position 22. As seen in FIG. 3, the end rail 20*c* is preferably passed through apertures in the rails 20*a* and 20*b*, although other suitable fasteners can be used. A second end rail 20*d* lies transversely to the rails 20*a* and 20*b* adjacent the second position 24. The pulleys 46 described above are supported by end rail 20*d* using suitable mounting brackets 47**.

Referring simultaneously to FIGS. 1 and 3, the rails **20*a* and 20*b* of the track are supported just above the platform by three spaced sets of support struts 50*a–b*, 52*a–b* and 54*a–b*. Support struts 50*a–b* are attached to the first end rail 20*c*. Support struts 52*a–b* are attached directly to the rails 20*a* and 20*b*, respectively, at or near the edge of the platform. The support struts 54*a–b* are located between the platform and that portion of the track 20 that extends out and over the edge of the platform. Support struts 54*a–b* thus serve to brace the outwardly-extending portion of the track. As seen in FIG. 3, the track 20 also includes a pair of downwardly-extending members 56*a–b* attached to the rails 20*a* and 20*b*, respectively. A cross bar 58 is attached across the ends of the members 56*a–b* for supporting one or more dampeners 60** for dampening the movement of the housing trap door as will be described.

Figure 4:
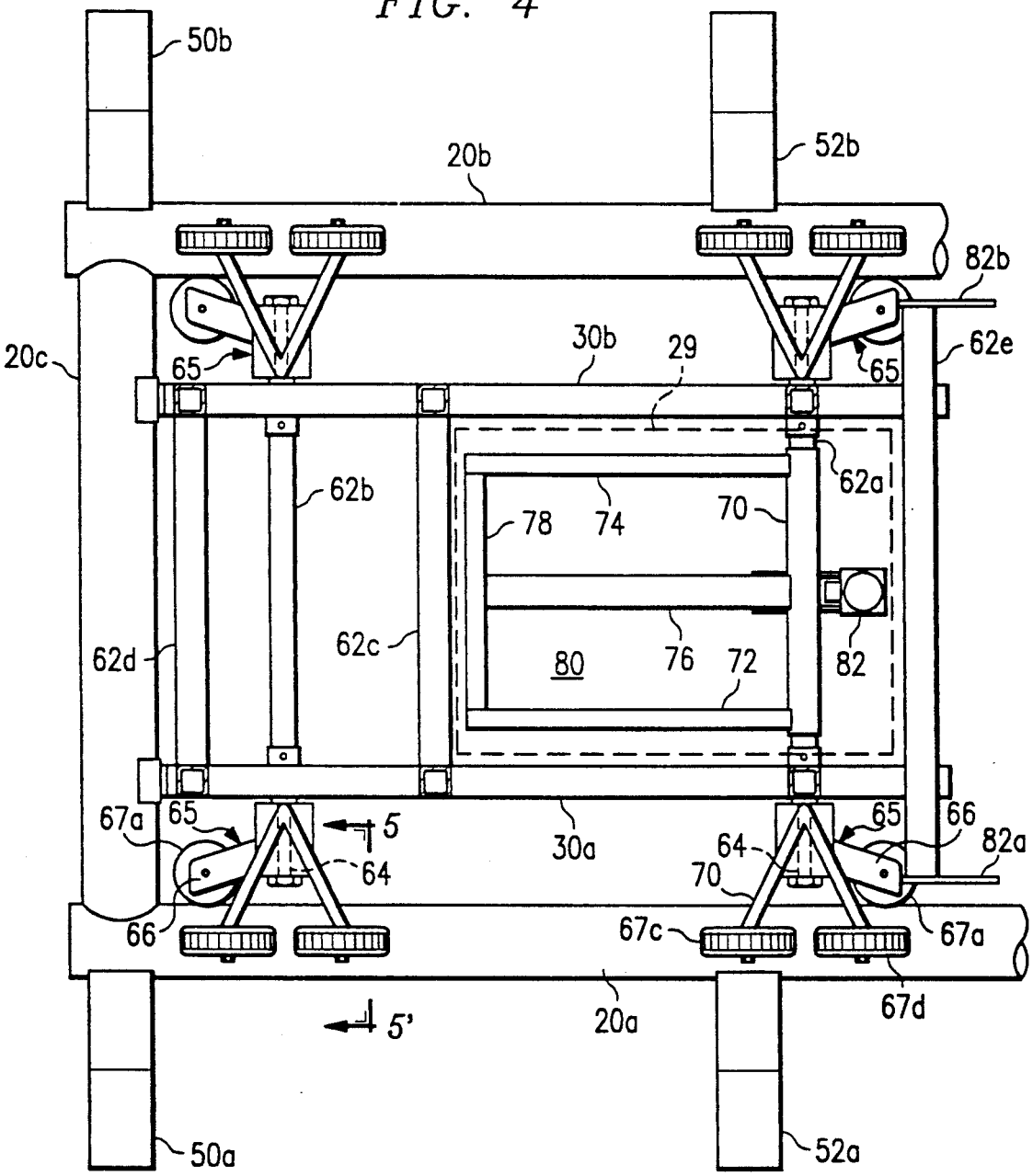
FIG. 4 is a detailed plan view of the carriage assembly showing the releasable trap door.

In particular, and with reference now to FIGS. 3–4, the carriage 30 includes a suitable mechanism for releasing the bottom of the housing 25 after the housing reaches the second or "discharge" position 24 to thereby drop the rider onto the slide. The carriage 30 includes a pair of parallel-spaced frame members **30*a* and 30*b* located between the first and second parallel-spaced rails 20*a* and 20*b* of the track 20. First and second cross members 62*a–b* lie transversely to the frame members 30*a–b*. A shaft 64 extends through each cross member 62 and has first and second ends extending beyond the frame members 30. According to the invention, a hub assembly, designated generally by the reference numeral 65, is rotatably mounted on each of the first and second ends of each shaft 64. The hub assembly supports a plurality of rollers against the rails to facilitate reciprocal movement of the carriage 30 on the track 20**.

Figure 5:
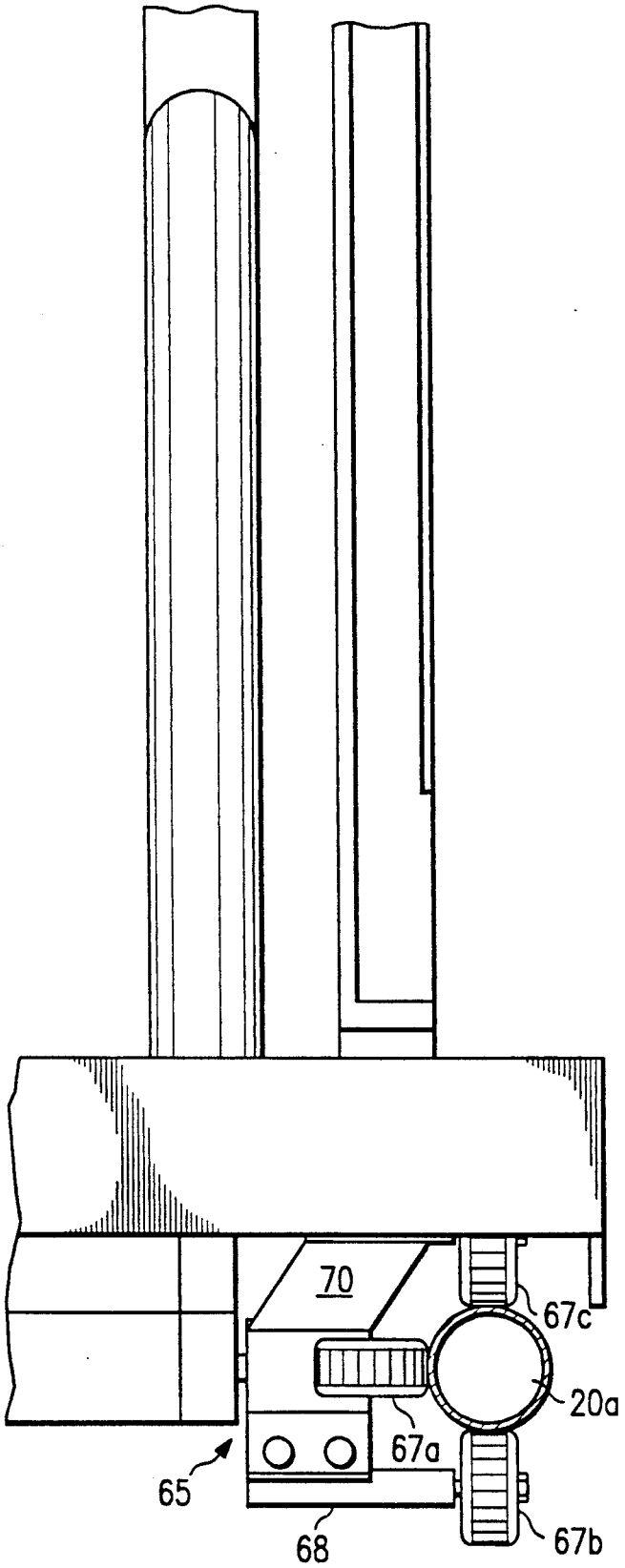
FIG. 5 is an end view along lines 5—5' showing the preferred construction of the hub and roller assembly for reciprocating the carriage assembly on the track.

Referring now to FIGS. 4–5, the hub assembly includes a support bracket 66 (best seen in FIG. 4) for supporting a roller **67*a*. Roller 67 is thus located between one of the frame members of the carriage and the associated rail. Hub assembly also includes support bracket 68 (best seen in FIG. 5) for supporting a roller 67*b* below the rail, and a Y-shaped support bracket 70 for supporting a pair of rollers 67*c–d*** above the rail.

Rollers 67*b–d* are thus located above and below the rail while roller 67*a* is oriented transversely to the other rollers of the hub assembly 65.

Referring now back to FIG. 4, the carriage 30 further also includes cross members 62*c* and 62*d* lying transversely to the frame members 30*a–b*. Cross member 62*a* is preferably circular in cross-section and supports a sleeve 70 rotatably-mounted thereon. The sleeve 70 includes support members 72, 74, 76 and 78, which form a rigid support 80 for the bottom 29 of the housing 25, shown in phantom. The sleeve 70 and associated support members thus form a trap door through the carriage 30. The bottom 29 of the housing (or a portion thereof) is attached to the support 80 and thus is carried therewith. Rotation of the sleeve 70 about the cross member 62*a* is effected through a suitable pneumatic cylinder and piston assembly 82. Specifically, when the cylinder is actuated, the piston is retracted, thus pivoting the support 80 (and the attached bottom 29 of the housing) downward to release the rider from the housing. This action is shown in phantom in FIG. 2. Following the dropping of the rider, the piston is extended, thereby causing the support assembly 80 (and the housing bottom 29) to return to its original position shown in FIG. 4. Thereafter, the carriage is returned to the first position 22 as previously described.

As also seen in FIG. 4, the carriage 30 includes an additional cross bar 62*e* having a pair of brackets 82*a–b*, one at each end. Each of the cables is attached to a bracket 82 to enable the drive mechanism to reciprocate the carriage on the track as previously described.

Figure 6:
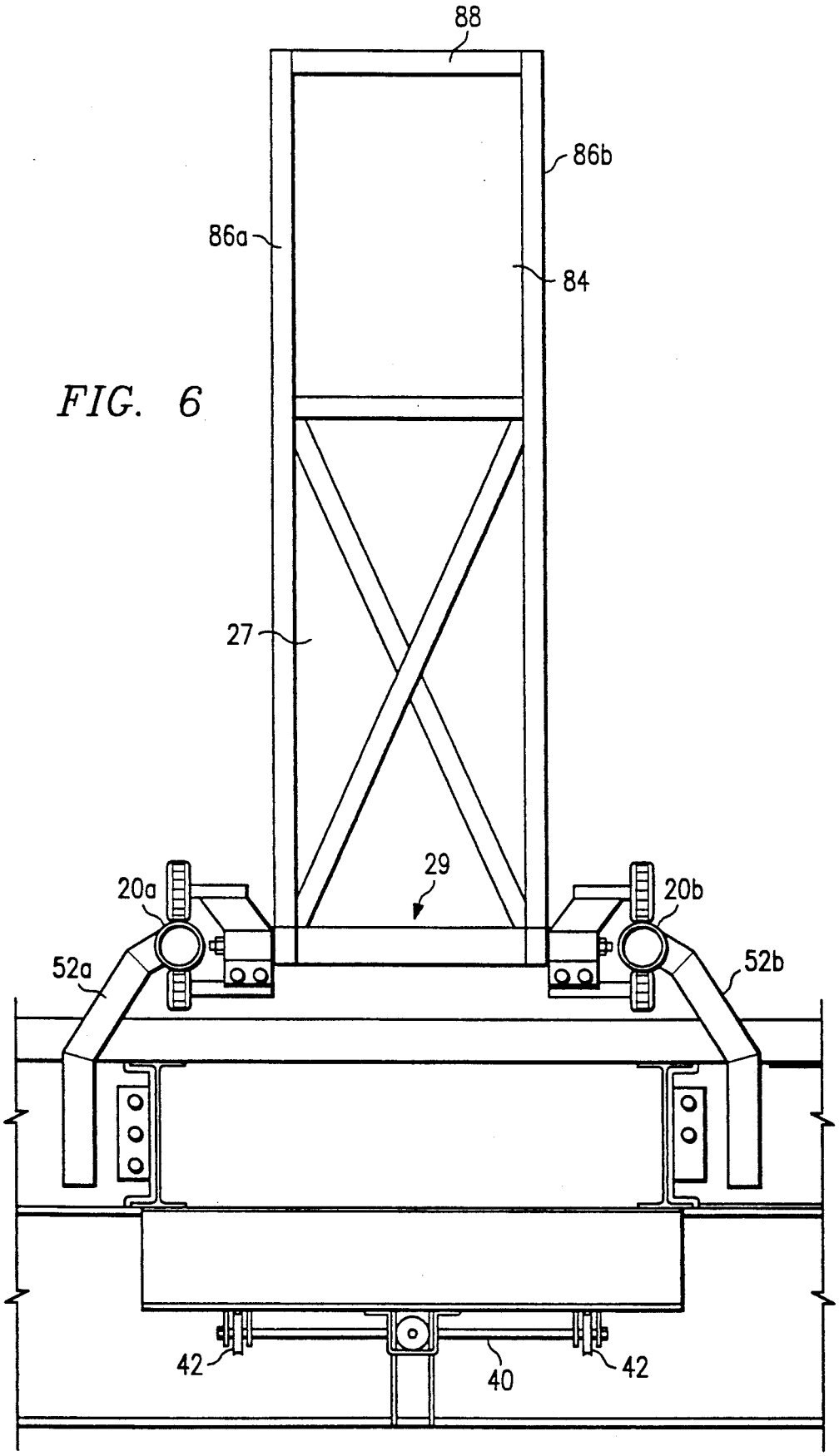
FIG. 6 is a detailed cross-section of the apparatus including the housing frame.

Referring now to FIG. 6, an end view of the housing 25 is shown. In addition to the back 27 and bottom 29, housing includes a front 84, a pair of sides 86*a–b*, and a top 88. The door is supported in one of the sides 86. FIG. 6 also discloses the structure of the intermediate set of support posts 52*a–b* and the yoke assembly 40 of the drive mechanism. Referring simultaneously to FIGS. 1–2 and 6, preferably the apparatus includes a shroud 21 overlying the housing 25 and formed in the shape of a bomb or the like. The apparatus may also include a shroud 23 overlying the track and formed in the shape of an aircraft fuselage. Given the operation of the trap door of the housing, the shrouds 21 and 23 create a simulated "bombing" effect, with the rider serving as the "bomb," when the method of the present invention is carried out as described above. In addition, preferably a water hose or other suitable conduit is connected to the interior of the housing (adjacent the top 88) to create a water flow down the interior side of the back 27. This water flow reduces the friction between the rider and the back 27, thereby increasing the speed at which the rider is discharged from the housing when the trap door is released. The water slide also includes a water stream as is known in the art.

Although not disclosed in detail, it should be noted that a conventional electropneumatic control system is used to effect the various operations described above. Such systems are well-known in the art and include suitable relays, limit switches and other timing devices to control the initiation and operation of the various mechanical and pneumatic devices.

It should be appreciated by those skilled in the art that the specific embodiments disclosed above may be readily utilized as a basis for modifying or designing other structures or methods for carrying out the same purposes of the present invention. For example, it is possible to initiate the ride directly from the simulated bomb housing instead of extending the housing over and above the water slide. In such a method, the rider is placed in a substantially erect position within the simulated bomb housing while the housing is located on the raised access platform. As described, the housing has a back and a releasable bottom, but in this case the back of the housing is aligned with the predetermined plane of the slide support surface when the rider is loaded. This can be accomplished, for example, by placing the upper end of the water slide directly underneath the housing. With the rider supported in this position, the bottom of the housing is then released to eject the rider onto the water slide. Alternatively, instead of using an upwardly curved track (such as shown in FIG. 1) that lifts the housing out and over the upper end of the water slide, the track may remain in the same horizontal plane and curve laterally in a left or right direction; in such case the upper end of the water slide would be located adjacent a side edge of the raised access platform. Such equivalent constructions do not depart from the spirit and scope of the invention as set forth in the appended claims.

What is claimed is:

1. A method for initiating a thrill-seeking ride from a raised access platform, the ride having a slide descending at a predetermined angle with respect to the platform and wherein the slide has a support surface located along a predetermined plane, comprising the steps of:

(a) placing a rider in a substantially erect position within a housing while the housing is located at a first position on the raised access platform, the housing having a back and a releasable bottom;

(b) extending the housing with the rider therein from the first position on the raised access platform to a second position wherein the back of the housing is aligned with the predetermined plane of the slide support surface; and (c) releasing the bottom of the housing to drop the rider onto the slide.

2. The method as described in claim 1 further including the steps of:

(d) retracting the bottom of the housing; and (e) returning the housing from the second position to the first position to receive another rider.

3. The method as described in claim 2 further including the step of:

(f) repeating steps (a)–(e) for another rider.

4. The method as described in claim 1 further including the step of waiting a predetermined time period between steps (b) and (c).

5. The method as described in claim 1 wherein the slide is a water slide.

6. The method as described in claim 1 wherein the slide has an upper end located above an edge of the raised access platform 7. The method as described in claim 1 wherein the slide has an upper end located adjacent an edge of the raised access platform.

8. A method for initiating a thrill-seeking ride from a raised access platform, the ride having a water slide descending at a predetermined angle with respect to the platform and wherein the water slide has a support surface located along a predetermined plane, comprising the steps of:

(a) placing a rider in a substantially erect position within a simulated bomb housing while the housing is located on the raised access platform, the housing having a back and a releasable bottom and wherein the back of the housing is aligned with the predetermined plane of the slide support surface; and (b) releasing the bottom of the housing to drop the rider onto the water slide.

9. Apparatus for initiating a thrill-seeking ride from a raised access platform, the ride having a slide descending at a predetermined angle with respect to the platform and wherein the slide has a support surface located along a predetermined plane, comprising:

a track supported on the platform and extending from a first position along the raised platform to a second position located above an upper end of the slide;

a housing having at least a back and a bottom for supporting a rider in an erect position;

a carriage supporting the housing and adapted for rolling movement on the track;

means for reciprocating the carriage along the track to extend the housing with the rider therein from the first position to the second position: and means for releasing the bottom of the housing after the housing reaches the second position to drop the rider from the housing onto the slide.

10. Apparatus as described in claim 9 wherein the slide is a water slide.

11. Apparatus as described in claim 9 wherein the means for releasing the bottom of the housing includes means for retracting the bottom following dropping of the rider onto the slide.

12. Apparatus as described in claim 11 wherein the means for reciprocating the carriage includes means for returning the housing from the second position to the first position to receive another rider.

13. Apparatus as described in claim 9 wherein the housing also includes a front, a pair of sides and a top, and wherein one of the sides includes an access door.

14. Apparatus as described in claim 9 wherein the track comprises:

first and second parallel-spaced rails each having an upwardly-curving profile;

a first end rail lying transversely to the first and second parallel-spaced rails and located adjacent the first position;

a second end rail lying transversely to the first and second parallel-spaced rails and located adjacent the second position; and means for supporting the first and second parallel-spaced rails on the raised access platform.

15. Apparatus as described in claim 14 wherein the track includes support means at one end and dampening means supported on the support means for cushioning the bottom of the housing after the bottom is released.

16. Apparatus as described in claim 14 wherein the carriage comprises:

a pair of parallel-spaced frame members located between the first and second parallel-spaced rails of the track;

at least one cross member lying transversely to the parallel-spaced frame members;

a shaft extending through the cross member and having first and second ends extending beyond the frame members;

a hub assembly rotatably mounted on each of the first and second ends of the shaft; and rollers means attached to each hub assembly and supported against one of the rails of the track.

17. Apparatus as described in claim 16 wherein the carriage further includes:

a sleeve rotatably mounted on the cross member;

a plurality of support members extending from the sleeve and attached to the bottom of the housing.

18. Apparatus as described in claim 17 wherein the means for releasing the bottom of the housing causes the sleeve to rotate on the cross member.

19. Apparatus as described in claim 9 wherein the means for reciprocating the carriage comprises:

a system of pulleys;

at least one cable supported by the system of pulleys; and a drive mechanism operably coupled to the carriage by the cable and the system of pulleys.

* * * * *